United States Patent [19]

Shoemaker, Jr.

[11] Patent Number: 4,822,045

[45] Date of Patent: Apr. 18, 1989

[54] ROLLING BALL GAME

[76] Inventor: Stephen P. Shoemaker, Jr., 123 International Boardwalk, Redondo Beach, Calif. 90277

[21] Appl. No.: 83,377

[22] Filed: Aug. 10, 1987

[51] Int. Cl.[4] ..... A63B 67/14; A63D 3/02

[52] U.S. Cl. ..... 273/110; 273/120 A; 273/121 E

[58] Field of Search ..... 273/109, 110, 121 E, 273/128 A, 119 A, 120 A

[56] References Cited

U.S. PATENT DOCUMENTS

| | | | |
|---|---|---|---|
| 145,385 | 12/1873 | Bean | 273/120 R |
| 570,105 | 10/1896 | Ryan et al. | 273/119 R |
| 699,490 | 5/1902 | Buxton | 273/113 |
| 1,595,071 | 8/1926 | Carlson | 273/110 |
| 2,426,915 | 9/1947 | Bains, Jr. | 273/120 A |
| 3,785,650 | 1/1974 | Halliburton | 273/110 |
| 3,985,360 | 10/1976 | Meyer | 273/110 |
| 4,089,525 | 5/1978 | Palazzolo | 273/101 |
| 4,236,716 | 12/1980 | Douglas, Jr. | 273/110 |
| 4,236,716 | 12/1980 | Douglas, Jr. | 273/110 |
| 4,325,551 | 4/1982 | Kulesza et al. | 273/110 |
| 4,669,727 | 6/1987 | David | 273/110 |
| 4,746,121 | 5/1988 | David | 273/110 |

FOREIGN PATENT DOCUMENTS

| | | | |
|---|---|---|---|
| 819666 | 10/1937 | France | 273/110 |
| 2440209 | of 1980 | France | 273/110 |

*Primary Examiner*—Richard C. Pinkham
*Assistant Examiner*—Gary Jackson
*Attorney, Agent, or Firm*—Brown, Martin, Haller & McClain

[57] ABSTRACT

An amusement apparatus comprises a pair of spaced elongate members defining a track and a rolling member for rolling along the track under the control of an operator. The elongate members are spaced a fixed distance apart at their first ends, this end comprising the normal home position of the rolling member. The opposite, second ends of the elongate members are movable relative to one another to adjust their spacing and to control movement of the ball along the track. The second ends are preferably mounted on a transversely extending track and are moveable towards and away from one another along the track. A drive assembly drives the second ends and a control device, which is at least partially controllable by the operator, controls operation of the drive assembly. The operator must control separation of the elongate members so that the rolling member can roll from its home position to the opposite end of the track without falling through the opening between the elongate members.

13 Claims, 4 Drawing Sheets

ROLLING BALL GAME

BACKGROUND OF THE INVENTION

The present invention relates generally to an amusement apparatus of the coin or token operated type in which a player or operator controls a game of skill in attempting to retrieve an article or prize.

A toy is known in which a player actively or personally attempts to control the movement of a ball along a track defined between two rods. The rods are fixed at one end where the ball is normally seated, and the player holds the opposite ends of the rods and moves them towards and away from each other in order to control rolling of the ball along the track. The object of the game is to move the ball from the fixed ends of the rods to the opposite end without allowing it to fall through the space between the rods.

SUMMARY OF THE INVENTION

It is an object of the present invention to provide an amusement apparatus in which the player remotely controls movement of a rolling ball along a track.

According to the present invention, an amusement apparatus is provided in which two spaced rods define a track on which a ball or other rolling member is seated, the rods being spaced a fixed distance apart at their first ends which define a start position and being moveable towards and away from each other at the opposite, second ends which define an end position. A guide assembly is provided for guiding the second ends of the rods to move transverse to the track, and a drive assembly is provided for driving the ends back and forth. A control assembly controls the drive assembly and thus the separation between the moveable rod ends. The control assembly incorporates a player operated device allowing at least partial control by the player of the movement of the moveable rod ends.

Preferably, the guide assembly comprises a guide rail extending transverse to the second ends of the rods on which the second ends are moveably mounted via rollers or the like. The apparatus is suitably enclosed within a housing having viewing windows for allowing the player to see movement of the rolling ball and rod ends. The player operated device may comprise an external joystick, lever, control button or similar device. The object is to move the rolling ball from its home position to the opposite end of the track without allowing it to fall through the gap between the rods. Thus the player first separates the moveable ends of the rods to start the ball rolling, and then must move them back towards each other so that the ball cannot fall down between them. A sensor device may be provided to detect the ball reaching the end of the track. The sensor device is associated with a prize or token dispensing assembly for dispensing a prize or token to the player whenever the ball is successfully controlled to move from the home position to the opposite end of the track.

In a preferred embodiment a capture assembly is provided beneath the rods to capture the ball if the player allows it to fall through the gap between the rods. The capture assembly suitably includes an elevator or lifting mechanism for automatically returning the ball to the track each time this occurs.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

The drawings show an amusement apparatus or mechanism 10 in which a player attempts to control movement of a rolling ball 12 along a track 14 defined between two spaced rods or rails 16,18. The mechanism shown in FIGS. 1 to 5 will in practice be enclosed within a suitable housing (not shown) with a viewing window or windows to enable the player or operator to view the ball movement.

Figure 1:
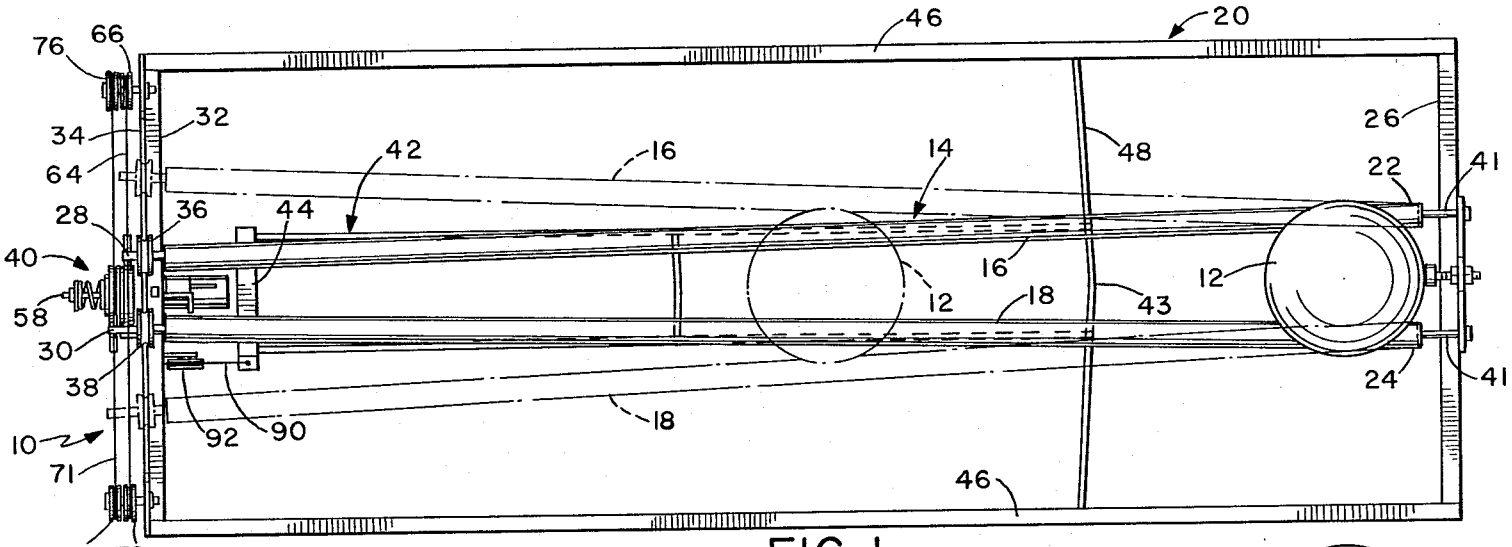
FIG. 1 is a top plan view of the complete apparatus according to a preferred embodiment of the invention.
Figure 2:
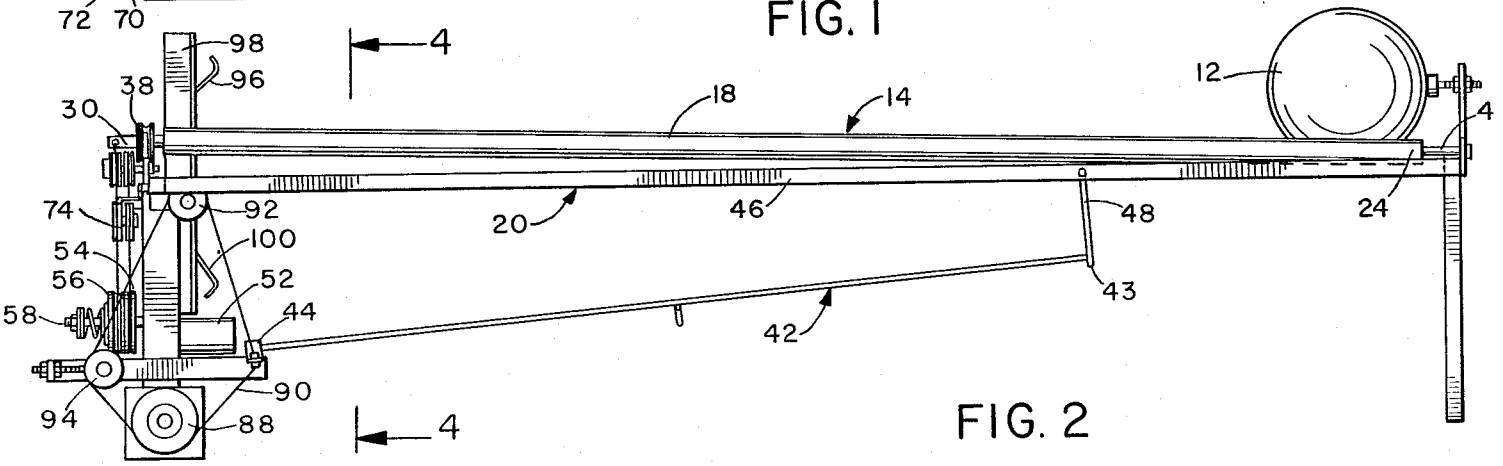
FIG. 2 is a side elevation view of the apparatus.

As best shown in FIGS. 1 and 2, the rods extend between opposite ends of a support frame 20 which raises the track above the ground or a horizontal floor in the housing (not shown). The first or rear ends 22, 24 of the rods are preferably pivotally secured to the rear end 26 of the frame, while the opposite, front ends 28, 30 of the rods are moveably mounted on the front end 32 of the frame. A suitable guide rail 34 extends across the front end of the frame, and rollers 36, 38 mounted on the front ends 28, 30, respectively, of the rods 16, 18, run along the rail 34. The ends 28 and 30 of the rods are linked to a drive assembly 40 (see FIG. 3) which controls movement of the rollers 36, 38 along the guide rail 34 and thus the separation of the ends 28, 30 of the rods, as explained in more detail below.

In the embodiment shown in the drawings, the rods are shown tilting downwardly from the front to the rear end of the frame. However, the frame may suitably be mounted and leveled in an outer housing so that the rods are horizontal or so that they tilt in the opposite direction. This will affect the difficulty of play, as explained in more detail below. The separation of the ends of the rods at the rear of the frame is preferably fixed, but it may be adjustable to provide a further difficulty adjustment if desired. The rear ends of the rods are pivotally connected to pins 41 to allow the front ends to move back and forth along guide rail 34. Any suitable pivot mounting or joint may be used.

Figure 5:
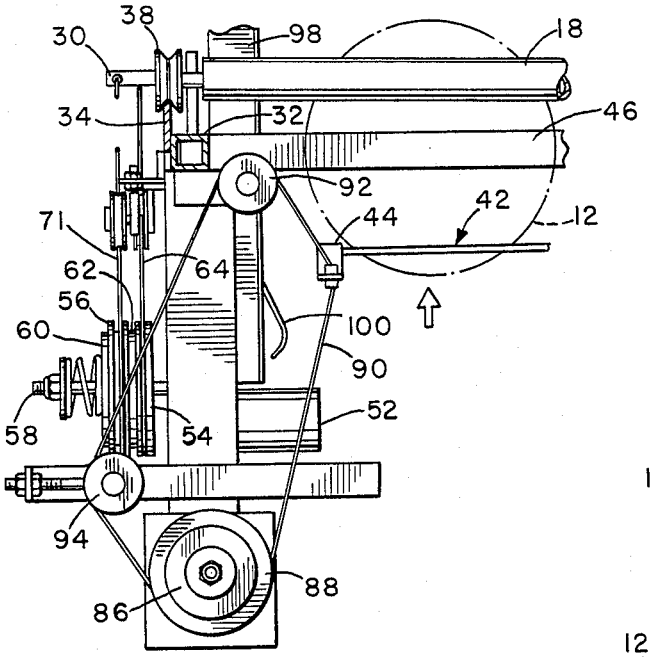
FIG. 5 is a sectional view on line 5—5 of FIG. 4, showing the elevator or reset action.

A cradle or capture assembly 42 is mounted beneath the rods to capture the ball if it falls down between them, as best shown in FIGS. 2 and 5. The cradle comprises a generally rectangular frame of width less than the ball diameter. The frame is shown in FIG. 2 in its normal or reset position in which it slopes downwardly from its rear end 43 closest to the rear end of the rods towards its front end 44. The rear end is suspended from the side arms 46 of the frame via support arms 48. The front end 44 of the cradle adjacent the front end of the frame is supported on an elevator assembly 50 which lifts it between the lowered, reset position shown in FIG. 2 to a raised position in which it is lifted close to the level of the track. As seen in FIG. 2, the cradle slopes downwardly towards the front of the unit in the reset position.

The rod drive assembly 40 which drives the rod ends 28, 30 along rail 34 will now be described in more detail with reference to FIGS. 1 to 3 and 5. The rod ends 28 and 30 are each linked via a pulley mechanism to drive motor 52. Two drive wheels 54, 56 (see FIG. 5) are mounted on the motor shaft 58 and a spring loaded slipping clutch 60 controls driving engagement between the shaft and the wheels. A friction plate 62 is provided between wheels 54, 56 so that either wheel can slip while the other is driven by the motor, in the event that rollers 36, 38 are off center, i.e. if one reaches the center or outermost position before the other. This enables the rod ends to be recentered.

Figure 3:
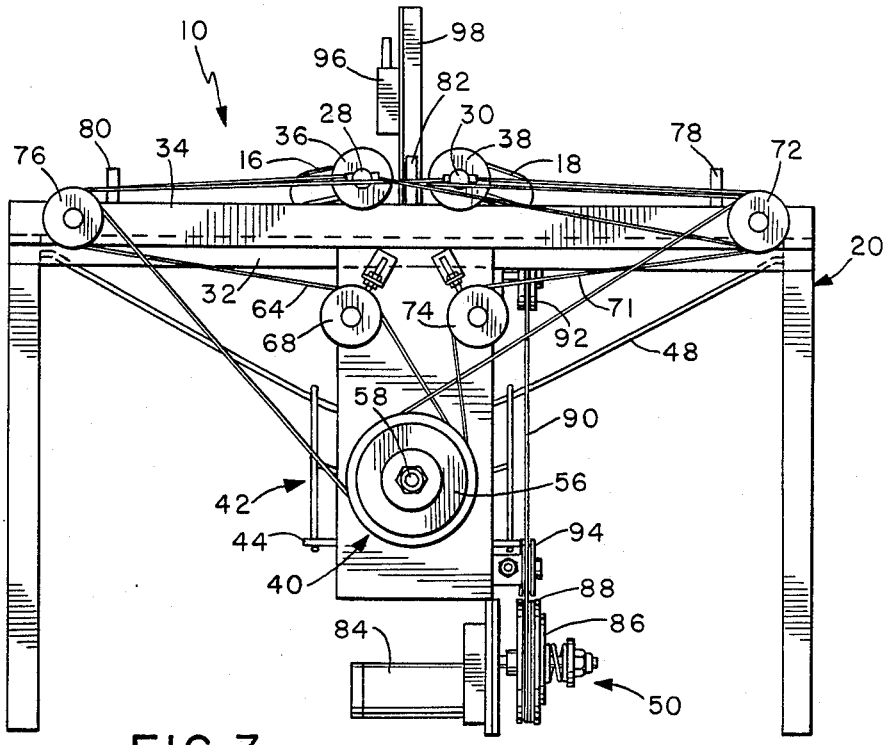
FIG. 3 is an enlarged front end view showing the drive system.

As best shown in FIGS. 1 and 3, a first pulley line or wire 64 is connected at one end to the free end 28 of rod 16 and extends over pulley rollers 66, 68, around drive wheel 54, and around pulley roller 70 at the opposite end of the rail 34 for connection at its opposite end to the end 28 of rod 16. Similarly, a second pulley line 71 is connected at one end to the end 30 of rod 18, extends around roller 72 at one end of rail 34, roller 74, drive wheel 56 and roller 76 at the opposite end of rail 34 for connection at its opposite end to the rod end 30. Stops 78, 80 are provided adjacent opposite ends of rail 34, and a center stop 82 is provided so that the rollers cannot collide. Thus, referring to FIG. 3, rotation of drive wheels 54, 56 in a first, clockwise direction will move rod end 28 from the center out towards the left hand end of rail 34, and will simultaneously move rod end 30 from the center out towards the right hand end of rail 34. Rotation of the drive rollers in the reverse direction will draw both rod ends back towards the center of rail 34. Rollers 68, 74 are tensioning rollers. As mentioned above, if one roller reaches an end stop before the other roller, the other roller will not bind but will continue to be driven until it reaches the equivalent end position.

Figure 4:
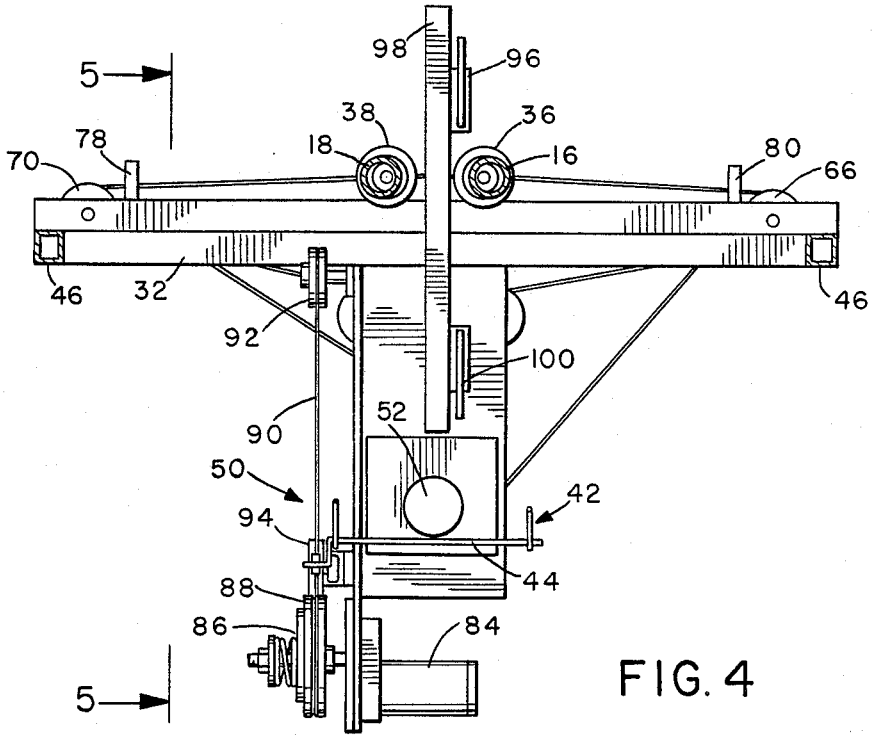
FIG. 4 is an enlarged sectional view taken on line 4—4 of FIG. 2.

The elevator assembly for raising and lowering the front end of cradle 42 is a similar pulley drive mechanism. As best shown in FIGS. 2, 4 and 5, a reset or elevator motor 84 is linked via slipping clutch 86 to drive wheel 88. A pulley line 90 extends from the front end of cradle 42, around upper roller 92, tensioning roller 94 and drive wheel 88 for connection at its opposite end to the front end of the cradle. Clockwise rotation of drive wheel 88 will lower the cradle, while anti-clockwise rotation will raise it.

Figure 6A:
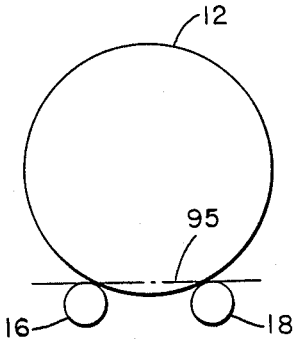
FIGS. 6A and 6B illustrate diagrammatically the change in level of contact between the rolling ball and the support rails or rods as the rails are separated.
Figure 6B:
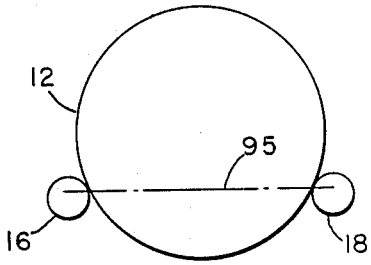

A home or start position for the ball is defined at the first or rear ends of the rods as shown in FIG. 1 and 2. The object of the game is for the operator to control separation of the front ends of the rods so that the ball rolls along the track from the rear to the front end of the frame, defining an end or win position. The control of ball movement can be best understood with reference to FIGS. 6A and 6B. When the rods are parallel to one another, the ball will remain stationary. At the position shown in FIG. 6A the rods are closer together than in FIG. 6B, so that the ball sits higher on the track, as indicated by the line 95 extending between the points of contact between the ball and the rods in FIGS. 6A and 6B. If the rods are closer together at one end than at the other end by a predetermined amount, the ball will tend to roll towards the end of the track where the ends are farther apart, since the ball will effectively be falling between the position shown in FIG. 6A where it most of the ball surface is above the track and the position shown in FIG. 6B where it has fallen partially through the rods. Thus, as the ends 28, 30 are separated, the ball will at some point start to roll along the rods towards the front end of the unit, as indicated by the dotted lines in FIG. 1. The point at which the ball starts to move will depend on the horizontal tilt of the track, so that the game difficulty can be adjusted by changing the tilt. The game will be more difficult if the track tilts upwards than if it is horizontal, for example, since the rods will have to be separated farther to start the ball moving. If the ball reaches the opposite end of the track without falling down between the rods, it will actuate a so-called "win" switch 96 mounted on support post 98 at the front end of the frame.

If the rod ends are separated too far, the ball will fall down through the gap between the rods onto the cradle. Because of the cradle tilt in the normal position shown in FIG. 2, the ball will roll towards the front end 44, where it will actuate a "lose" switch 100 mounted on the opposite end of post 98.

Figure 7:
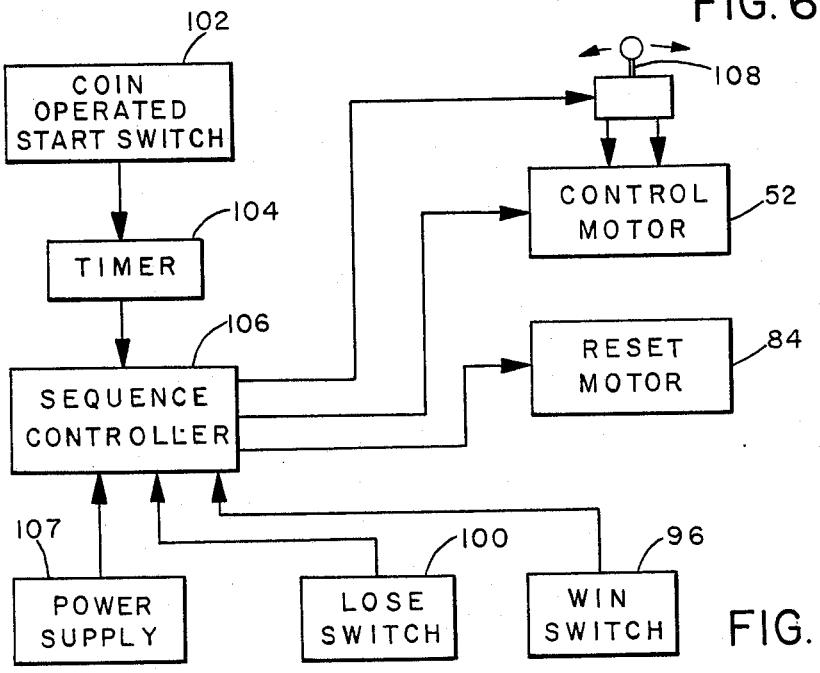
FIG. 7 is a block diagram of the control system.
Figure 8:
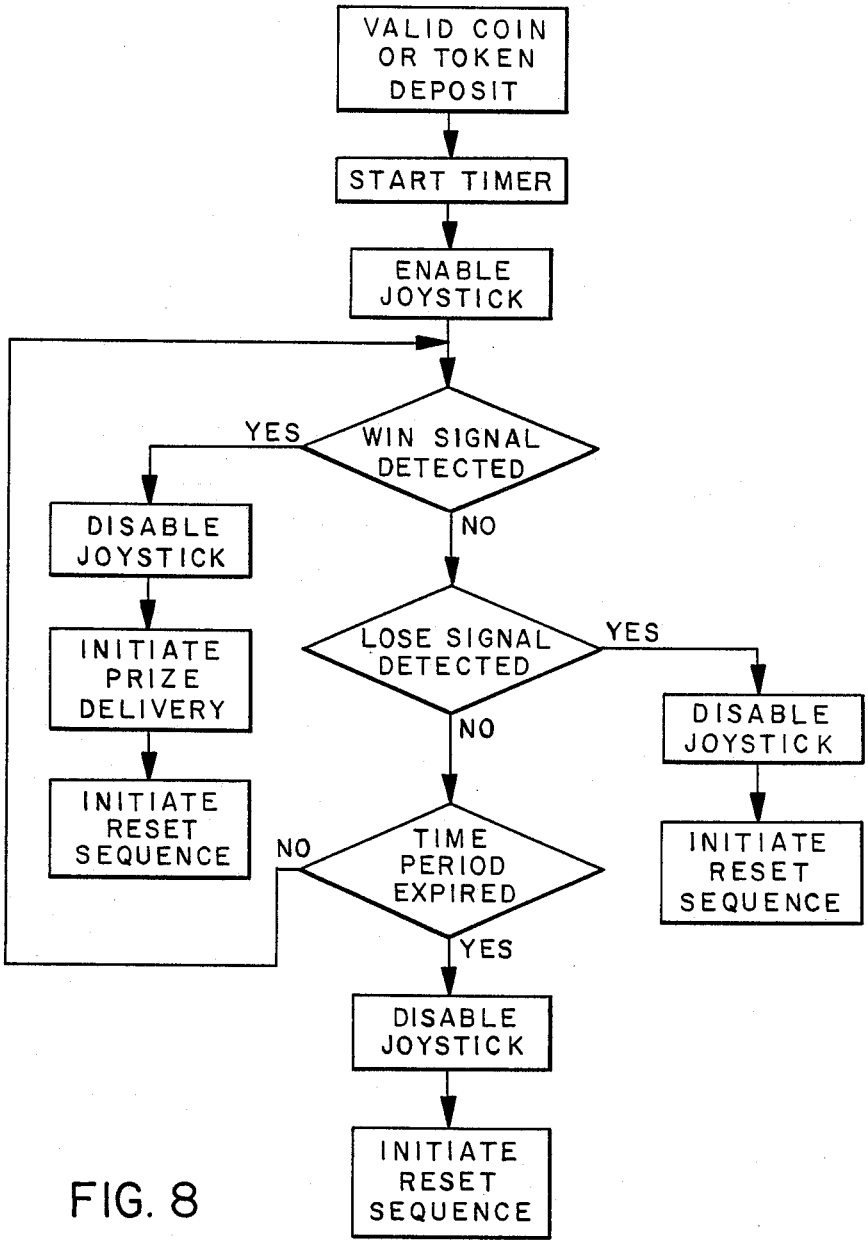
FIG. 8 is a flow diagram of the game sequence.

Operation of the apparatus will now be described in more detail with reference to the control system illustrated in FIG. 7 and the flow diagram of FIG. 8. The apparatus preferably includes various external controls mounted on the housing enclosing the unit. The controls are accessible to the operator and preferably include a coin or token deposit slot which controls actuation of start switch 102 to initiate the game sequence. This operates a timer 104 and microprocessor controlled sequence controller 106 which is programmed to control play according to a predetermined game sequence. The controller 106 controls connection of the drive motors to power supply 107. FIG. 8 shows a preferred game sequence which the controller is programmed to carry out.

As soon as a coin or token is entered, an external joystick 108 or other control device is enabled to allow the operator to control the direction of movement of rod ends 28, 30. Power is supplied to rod drive motor 52, so that if the operator moves the joystick in one direction the rod ends will move apart and when the joystick is moved the opposite way the rod ends move together. There is preferably no movement of the rods when the joystick is in a neutral position, in other words the joystick controls both operation and direction of motor 52.

After the coin is inserted there are only three possible alternatives, as indicated in FIG. 8. First, the player may successfully guide the ball to the end or win position at the front end of the unit to actuate the win switch. Secondly, the player may separate the rods too far and allow the ball to fall through, actuating the lose switch. Finally, the player may run out of time before completing the game. The controller is programmed to detect each of these possibilities and to operate the system accordingly. Preferably, the player is only allowed to control the rod movement for a certain time period under the control of timer 104. If the time period expires before any win or lose signal is detected, the controller 106 will override the joystick, and will initiate a reset sequence to return the ball to its home position ready for subsequent play. The reset sequence comprises first causing rod drive motor 52 to rotate clockwise, opening the ends of the rods until the ball falls onto the cradle or reset mechanism. After a predetermined time interval, elevator or reset motor 88 will be operated in a clockwise direction, raising the ball back towards the track. After a second time interval, sufficient to allow the ball to be raised to the upper limit of the elevator mechanism, the rod drive motor will be reversed causing the rods to close and catching the ball between the closed rods. The ball will then roll down the rods towards the rear end of the frame ready for the next game sequence. Meanwhile the reset motor will be reversed to lower the cradle to its normal, reset position.

If the operator opens the rods too far during the time period when the joystick is enabled, the ball will fall down between the rods and will be captured by the cradle. The ball will roll down the cradle until it hits the reset or lose switch 98. The resultant "lose" signal is detected by the sequence controller to override the joystick and to return the ball to its home position according to the reset sequence described above. If the operator successfully controls the rods to roll the ball to the front end of the frame during the alloted game period, the ball will strike the win switch, and the controller will detect the resultant "win" signal. The joystick is disabled, and the controller initiates a prize delivery or win sequence for dispensing a prize to the player and also initiating the reset sequence described above. The win sequence initiates a control signal for actuating a prize or token dispenser of a standard type for delivering a prize to the operator. The controller may operate to award a series of different prize levels according to how quickly the operator manages to actuate the win switch. Thus, for example, the highest level prize may be awarded for a win within 5 seconds, a lower prize for a win within 10 seconds, and the lowest prize awarded for a win in more than 10 seconds. Any time limit may be allowed for each game sequence, but it is anticipated that a time period of the order of 20 seconds or more will be appropriate. The apparatus may be provided with controls for adjusting the alloted time period. A prize light may also be provided on the apparatus which would signal a win to a player.

The reset sequence following actuation of the win switch may involve simply moving the rod ends towards one another so that the ball rolls back to the rear end of the housing. However, the reset sequence is preferably the same in this case as described above for the situation where a player runs out of time, involving separation of the rods to allow the ball to fall onto the cradle, raising of the cradle and capture of the ball by moving the rod ends together, so that the ball rolls back to the home position.

Generally, control of the ball movement will involve first separating the rod ends to start the ball rolling and subsequently moving the rods back towards one another so that the ball does not fall down between them. If the rods are moved too far back towards one another, the ball may stop or even reverse. Thus judgement and skill is required to roll the ball successfully to the front of the unit, and players will generally improve with experience. Play may be made more difficult by raising the front end of the housing, as explained above, requiring the rods to be separated farther to start the ball rolling and thus making it more difficult to prevent it from falling down between the rods. Play will also be more difficult when the rear ends of the rods are mounted closer together, so that the ball will tend to roll faster, allowing less time for adjustment of the rod separation. Another way in which difficulty may be increased would be to make separation of the rods on initiation of a game sequence automatic, with the only player control being operation of a button closing the rods. This would be more difficult for the player since there would be no coasting or stationary position of the rods once play had begun. Play may be made easier by lowering the front end of the housing and/or by increasing the separation between the rear ends of the rods.

The amusement apparatus described above provides a game of skill which can be operated by a simple control device such as a joystick, button or the like.

Although a preferred embodiment of the invention has been described above by way of example only, it will be understood by those skilled in the field that modifications may be made to the disclosed embodiment without departing from the scope of the invention, which is defined by the appended claims.

I claim:

1. An amusement apparatus, comprising:

a pair of spaced apart, elongate members defining a generally horizontal track spaced above the ground, the members having opposite first and second ends defining opposite first and second ends of the track, respectively, the first ends being spaced a fixed distance apart;

a rolling member seated on the track and moveable between opposite ends of the track;

a mounting assembly for guiding the second ends of the elongate members for movement towards and away from each other in a horizontal direction transverse to the track;

non-manual drive means for moving the second ends of the members towards and away from each other; and control means remote from the drive means for controlling operation of the drive means to adjust the separation of the second ends of the members to control rolling of the rolling member along the track, the control means including a player-controlled device for allowing at least partial control by the player of the drive means controlling movement of the second ends of the elongate members.

2. The apparatus as claimed in claim 1, wherein the mounting assembly comprises a guide rail extending transversely across the second ends of the track, the second ends of the track including guide members for guided engagement along the guide rail.

3. The apparatus as claimed in claim 1, including a capture assembly below the track for catching the rolling member when it falls down between the elongate members.

4. The apparatus as claimed in claim 3, including an elevator mechanism for raising the capture assembly to return a captured ball to the track.

5. The apparatus as claimed in claim 3, including lose sensor means for detecting capture of the rolling member by the capture assembly and for producing a corresponding game lost control signal, the control means including means for initiating a reset sequence for returning the rolling member to the first end of the track on detection of a game lost control signal.

6. The apparatus as claimed in claim 1, wherein the player-controlled device comprises means for controlling the direction of movement of the second ends of the elongate members.

7. The apparatus as claimed in claim 6 wherein the control means includes a timer for allowing player control during a predetermined time period, and for disabling the player-controlled device after expiry of the predetermined time period, and means for resetting the apparatus by returning the ball to the second end of the track after expiry of the predetermined time period.

8. The apparatus as claimed in claim 1, including win sensor means for detecting the arrival of the rolling member at the second end of the track and for producing a corresponding control signal, the control means including means for initiating a prize delivery sequence on detection of a control signal from the win sensor means.

9. The apparatus as claimed in claim 1, wherein the drive means comprises a pulley drive mechanism including a drive motor, a pair of drive wheels linked to the motor, and first and second pulley assemblies linking one drive wheel to the second end of one rod and the other drive wheel to the second end of the other rod, respectively.

10. The apparatus as claimed in claim 1, including a frame for supporting the elongate members above a predetermined level, the first ends of the elongate members being pivotally secured to one end of the frame and the second ends of the elongate members being moveably mounted at the opposite end of the frame.

11. An amusement apparatus comprising:

a pair of spaced rods defining a track having opposite first and second ends, the ends of the rods at the first end of the track being spaced a fixed distance apart;

a ball seated on the track and moveable between opposite ends of the track;

a guide rail extending transversely across the track; each rod being moveably mounted on the guide rail;

a drive motor linked to each of the rods so as to drive them in opposite directions along the guide rail to control separation between the ends of the rods at the second ends of the track; and a control assembly connected to the drive motor including a player controlled device for switching the motor on and for reversing the motor direction, and a switch controlling connection of the player controlled device to the motor.

12. The apparatus as claimed in claim 11, wherein the control assembly includes return means for controlling the drive motor to return the ball to the first end of the track at the end of a predetermined game sequence.

13. The apparatus as claimed in claim 11, including a housing, the rods, ball and guide rail being enclosed in the housing, the housing having a window for enabling an operator to view the movement of the ball along the rods, and the player-controlled device being mounted outside the housing for remote control of the rod movement by the operator.

* * * * *